US006513890B1

(12) United States Patent
Tolnes et al.

(10) Patent No.: US 6,513,890 B1
(45) Date of Patent: Feb. 4, 2003

(54) CONTAINER AND LOCKING DEVICE

(75) Inventors: John Harald Tolnes, Kristiansand (NO); Kåre Espen Kronborg, Kristiansand (NO)

(73) Assignee: Sapron AS, Kristiansand (NO)

( * ) Notice: Subject to any disclaimer, the term of this patent is extended or adjusted under 35 U.S.C. 154(b) by 0 days.

(21) Appl. No.: 09/787,304

(22) PCT Filed: Sep. 17, 1999

(86) PCT No.: PCT/NO99/00288

§ 371 (c)(1),
(2), (4) Date: May 4, 2001

(87) PCT Pub. No.: WO00/16660

PCT Pub. Date: Mar. 30, 2000

(30) Foreign Application Priority Data

Sep. 18, 1998 (NO) ..... 19984363

(51) Int. Cl.[7] ..... A47B 88/00; A47B 95/02; E05B 3/00

(52) U.S. Cl. ..... 312/333; 312/330.1; 312/348.6; 292/336.3; 292/DIG. 27

(58) Field of Search ..... 312/330.1, 332.1, 312/333, 319.1, 348.6; 70/85; 292/57, 58, 63, 64, 66, 71, 336.3, DIG. 27, DIG. 31, DIG. 63

(56) References Cited

U.S. PATENT DOCUMENTS

| | | | | |
|---|---|---|---|---|
| 2,129,810 A | * | 9/1938 | Bier | 70/85 X |
| 3,206,238 A | * | 9/1965 | Speight et al. | 312/333 X |
| 3,666,338 A | | 5/1972 | Russell | |
| 3,680,941 A | | 8/1972 | Shanks | |
| 3,856,339 A | | 12/1974 | Tornoe et al. | |
| 3,907,348 A | | 9/1975 | Bates et al. | |
| 4,099,756 A | | 7/1978 | Kagoura | |
| 4,389,062 A | | 6/1983 | Rosenberg | |
| 4,524,904 A | | 6/1985 | Masse et al. | |
| 4,647,093 A | | 3/1987 | Palsson | |
| 4,786,785 A | | 11/1988 | Felt | |
| 4,832,422 A | | 5/1989 | Fortmann | |
| 4,838,626 A | * | 6/1989 | Parr | 312/333 |
| 5,082,137 A | | 1/1992 | Weinstein | |
| 5,280,974 A | | 1/1994 | Weintroub | |
| 5,303,995 A | | 4/1994 | Kurihara | |
| 5,437,503 A | | 8/1995 | Baker et al. | |
| 5,551,124 A | | 9/1996 | Zeingue | |

FOREIGN PATENT DOCUMENTS

| | | |
|---|---|---|
| DE | 3301649 | 7/1983 |
| DK | 156739 | 5/1985 |
| EP | 0492115 | 7/1992 |
| FR | 2520214 | 7/1983 |
| GB | 2039599 | 8/1980 |
| GB | 2255798 | 11/1992 |
| GB | 2275496 | 8/1994 |
| NO | 174117 | 12/1993 |
| SE | 436593 | 1/1985 |

* cited by examiner

*Primary Examiner*—James O. Hansen
(74) *Attorney, Agent, or Firm*—Birch, Stewart, Kolasch & Birch, LLP

(57) ABSTRACT

A storage box for storage of objects in a suitable place with restriction of accessibility and the possibility of marking, the storage box comprising a main body, a drawer with a front panel and a lock device. The drawer is slidingly placed in the main body through an opening in one of the main body's surfaces, the lock device is installed on one of the main body's surfaces or on the front panel of the drawer, the lock device in the locked position connects the drawer to the main body and in the released position disengages the connection between the drawer and the main body. The lock device consists of a substantially cylindrical housing with an enlarged end piece, the enlarged end piece forms a seat shaped in a complementary manner to the underside of a handle, the handle operates a shaft provided in the housing, the shaft is movable in its longitudinal direction and can rotate in the housing. The lock device may be installed on the front panel of the drawer and engages with a lug mounted on the inside of one of the main body's surfaces.

7 Claims, 7 Drawing Sheets

CONTAINER AND LOCKING DEVICE

This application is the national phase under 35 U.S.C. §371 of PCT International Application No. PCT/NO99/00288 which has an International filing date of Sep. 17, 1999, which designated the United States of America.

FIELD OF THE INVENTION

The present invention relates to a storage box and a lock device therefor, which storage box can thereby be used for storing objects whose accessibility requires to be restricted. This may apply, for example, to storage of medicines and chemicals, which have to be kept inaccessible to children. At the same time objects in the storage box can be placed together in a suitable storage location, for example in a refrigerator, a dark room or the like.

DESCRIPTION OF THE BACKGROUND ART

It is a well-known problem in the home, at the place of work or in an institution that there are some objects which ought to be stored separately in a location suited to the purpose and preferably with restricted accessibility while at the same time it may be important to retrieve them quickly. This is often solved by attempting to conceal the objects concerned, or attempting to restrict their accessibility by placing them in a location where they are not accessible to everyone, preferably a location where an effort has to be made to get hold of them. Some objects, such as medicines and chemicals, however, often need special treatment and storage, since they may be particularly light-sensitive or require to be stored in a cold environment. It is therefore not very practical and often ill-advised to choose a storage place based only on considerations of storage environment or accessibility as this may have unfortunate consequences. A medicine container which has to be kept cold is naturally placed in a refrigerator or the like. Such a location, however, is accessible to most people and children, for example, also have access to a refrigerator and other cold rooms. It is a highly unfortunate combination to have medicines or chemicals accessible to children, and particularly in a storage place where children expect to find food or other harmless substances which can be eaten or drunk.

Thus in the storage of medicines and chemicals there is already a conflict at a basic level between the requirements which have to be taken into consideration with regard to the characteristics of the storage place, and at the same time requirements regarding safety and accessibility for those who are present.

Another well-known problem is how to to keep different substances in their proper place simultaneously, such as, for example, medicines, since they often come in small amounts and may be vital for a user who has to find them at short notice. This makes it necessary for such substances to be stored in a place suited to the purpose, in a manner which makes them easy to find and preferably in a specifically organized system. If the previously mentioned conditions with regard to restricted accessibility and requirements as to a suitable storage place are to be fulfilled, the result will often be that an arbitrary and unsuitable location is chosen for reasons of ease of retrieval. Here too parallels can be drawn with the example of storage of medicines in a refrigerator or in another cold place, where several different people usually avail themselves of the contents. This applies not only in connection with families, but also in companies, institutions and the like where there is common storage of, for example, food and drink in a refrigerator or in other suitable places. It is obvious that the more people who are involved in helping themselves to the contents, as well as replenishing the contents of such a place, the more difficult it is to ensure ease of retrieval for individuals, and particularly in the case of small items which are stored together with a large amount of other substances.

There are therefore three different requirements which have to be considered when storing, for example, medicines. They should be stored in a place suited to the purpose, they should be stored with suitable, preferably restricted accessibility, and they should be stored in a manner which ensures ease of retrieval within a desired time frame. This may apply, e.g., to the storage of medicines in a refrigerator where they are placed together with other foodstuffs and where there is a great risk that, e.g., children, weak-sighted or senile people may make a mistake about the contents of the refrigerator and help themselves to medicines instead of other substances in the refrigerator, or take the wrong medicine belonging to another person.

In previously known solutions for meeting these requirements and overcoming the above-mentioned problems, the usual method has been to collect the substances concerned in a separate area of, e.g., the refrigerator. This improves ease of retrieval, and if the area of the refrigerator in which this is stored is of such a nature that it can be closed or concealed, a restricted or controlled accessibility is thereby achieved. However, it is not possible to mark such a place in a suitable manner if it is a part of the natural refrigerator fittings or is simply only an "appointed" place in the refrigerator where it is agreed that such substances should be stored. Another solution for restricting accessibility is to store the individual medicine or the like in a container which is equipped by the medicine producer with an accessibility restricting means, for example in the form of a lid or the like which has to be handled in a special way in order to be opened. In this case, however, a situation is achieved where each individual medicine is stored in separate units, which have to be located separately in a suitable storage place. This can result in medicines being put in the wrong place or removed by mistake, thereby reducing the ease of retrieval, which may be a critical factor for persons whose lives are dependent on certain medicines.

BRIEF SUMMARY OF THE INVENTION

Thus it is the object of the present invention to provide a storage box which meets the above-mentioned requirements, and which overcomes the above-mentioned problems. The box according to the invention ensures that those substances which require to be stored are kept collectively in a manner which permits them to be placed together in a suitable location, for example in a refrigerator, in addition to which the storage box can be provided with a lock mechanism which permits particularly restricted access to the contents thereof.

The inventive concept in the present invention further comprises a lock device which forms part of a preferred embodiment of the lock device which is employed in connection with the said storage box.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and of the scope of the invention will become apparent to those skilled in the art from this detailed description.

BRIEF DESCRIPTION OF THE DRAWINGS

The invention will now be described in more detail in relation to the figures, which are given by way of illustration only, and thus are not limitative of the present invention, in which.

DETAILED DESCRIPTION OF THE INVENTION

Figure 1:
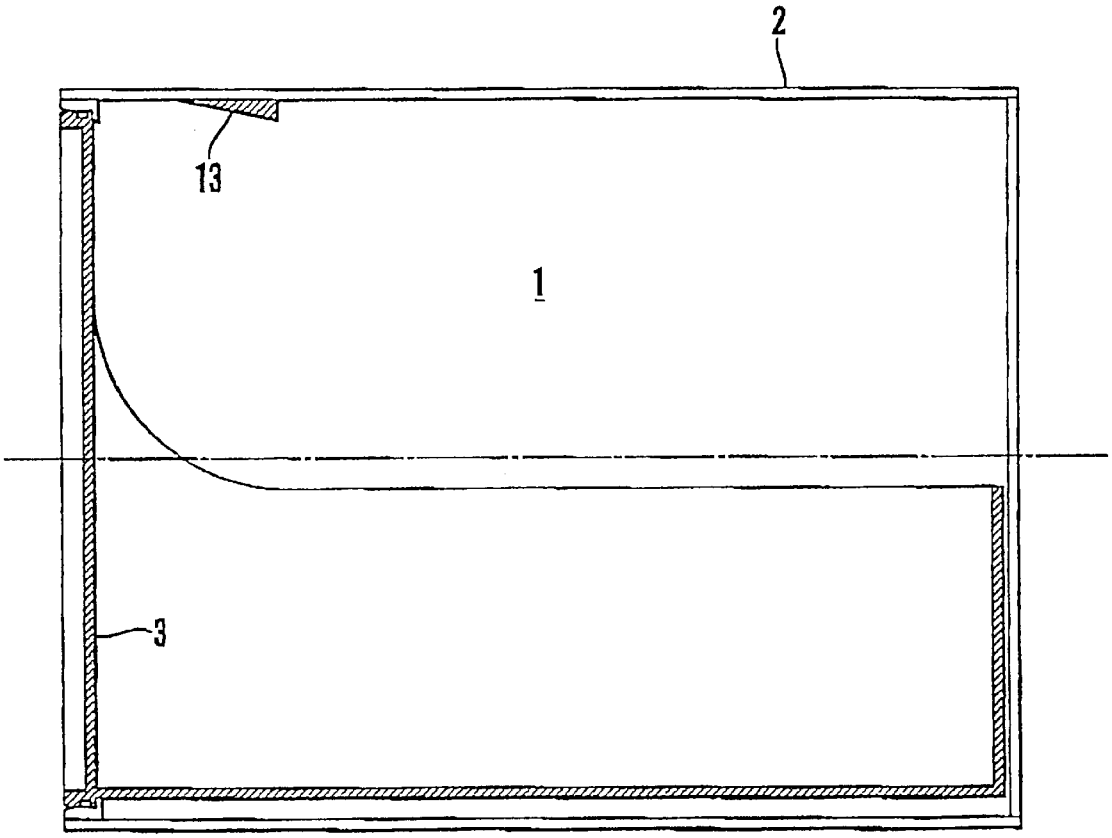
FIG. 1 is a sectional view from the side illustrating the storage box in its entirety consisting of a drawer and a main body.
Figure 2:
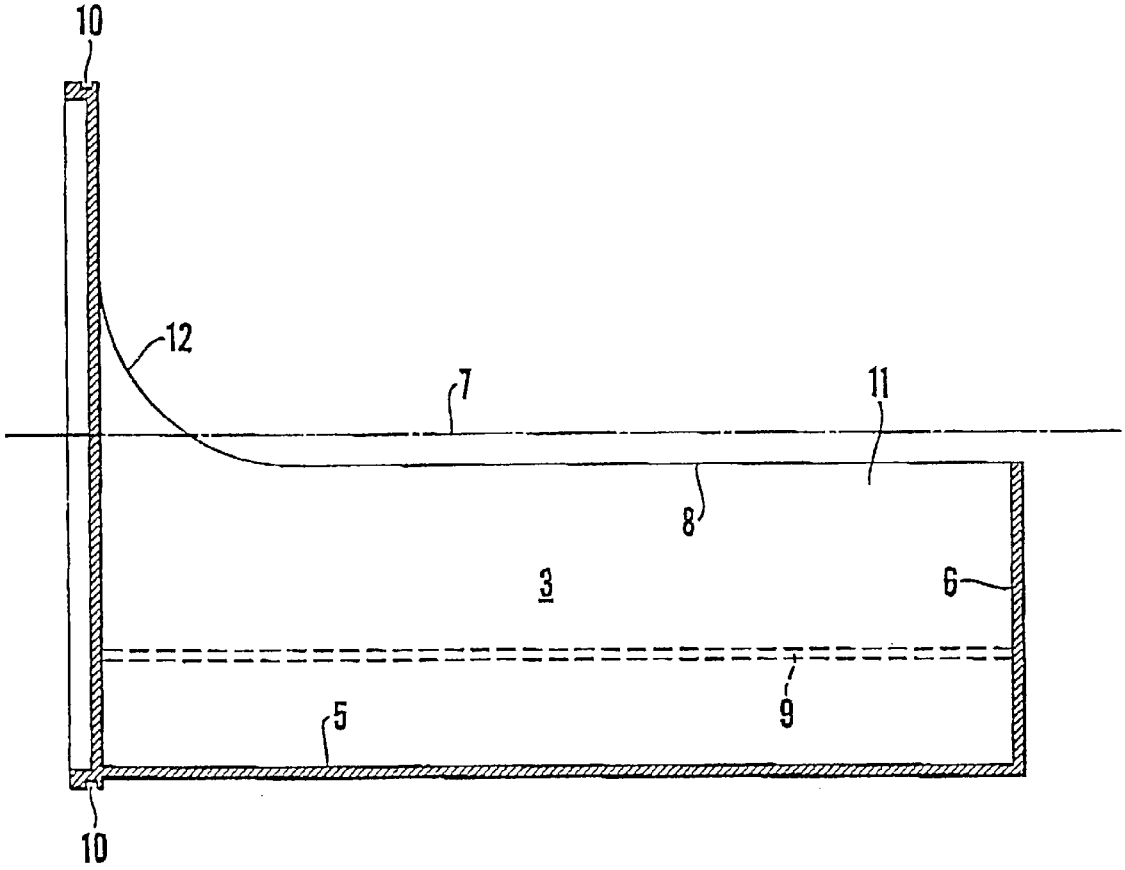
FIG. 2 is a sectional view from the side of the drawer which is disposed inside the main body of the storage box.

FIG. 1 illustrates a storage box according to the present invention, consisting of the two main elements, an external housing or main body 2 and a drawer 3, which is placed movably in and out of the main body 2 through an open side, or thereto suited opening in one of the sides of the main body 2. As illustrated in FIG. 2, the drawer 3 consists of a front piece 4 which is adapted in size to cover the opening in the main body 2, with the result that when the drawer 3 is pushed into the main body 2, the front piece 4 covers the whole or substantially the whole opening in the main body 2. The drawer 3 further has a bottom 5, a rear boundary 6 and side walls upwardly projecting from the bottom 5, which side walls are upwardly limited by an upper edge 8. In the area immediately behind the front piece 4, the upper limiting edge 8 may be given a rounding 12. In FIG. 2 the upper limiting edge 8 is illustrated mounted under the storage box's centre line 7, but it may be mounted at any level between the bottom and the upper part of the front piece 4, thus providing a drawer with everything from a flat bottom without lateral limiting edges 11 to a drawer with full height lateral limiting edges. If the lateral limiting edge 11 has full height it will not be possible to have a rounding 12 between the upper limiting edge 8 and the front piece 4. In addition the drawer 3 is mounted with a device 9 on at least one of the sides, but preferably on both sides of the drawer 3, which device 9 engages with a similar, and possibly oppositely formed device 23 with a similar location in the main body 2. The device 9 may, for example, be a mounted slide bar, a milled track for engagement with a slide bar 23 mounted in the main body 2, or similar elements. The use may be envisaged here of countless solutions which otherwise form part of the standard state of the art.

Figure 3:
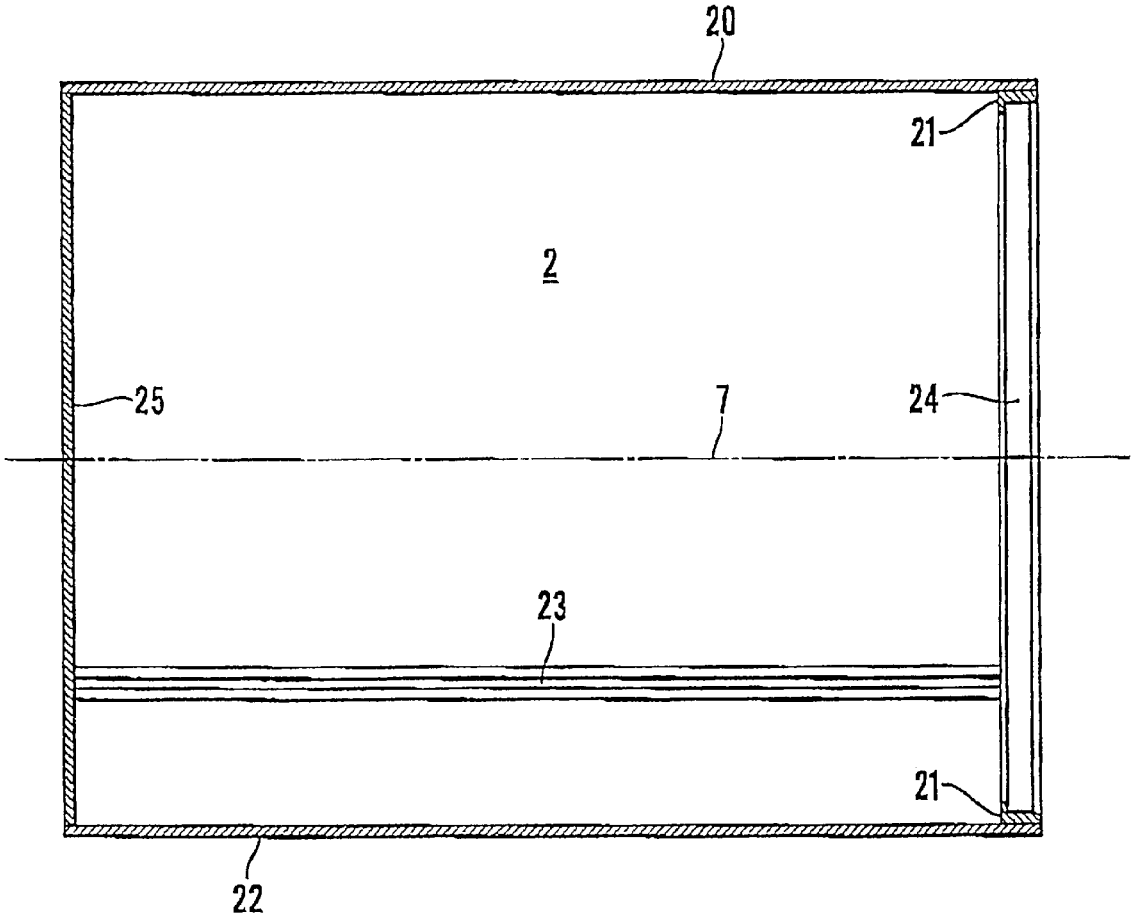
FIG. 3 is a sectional view from the side of the main body which constitutes the external unit of the storage box.
Figure 4:
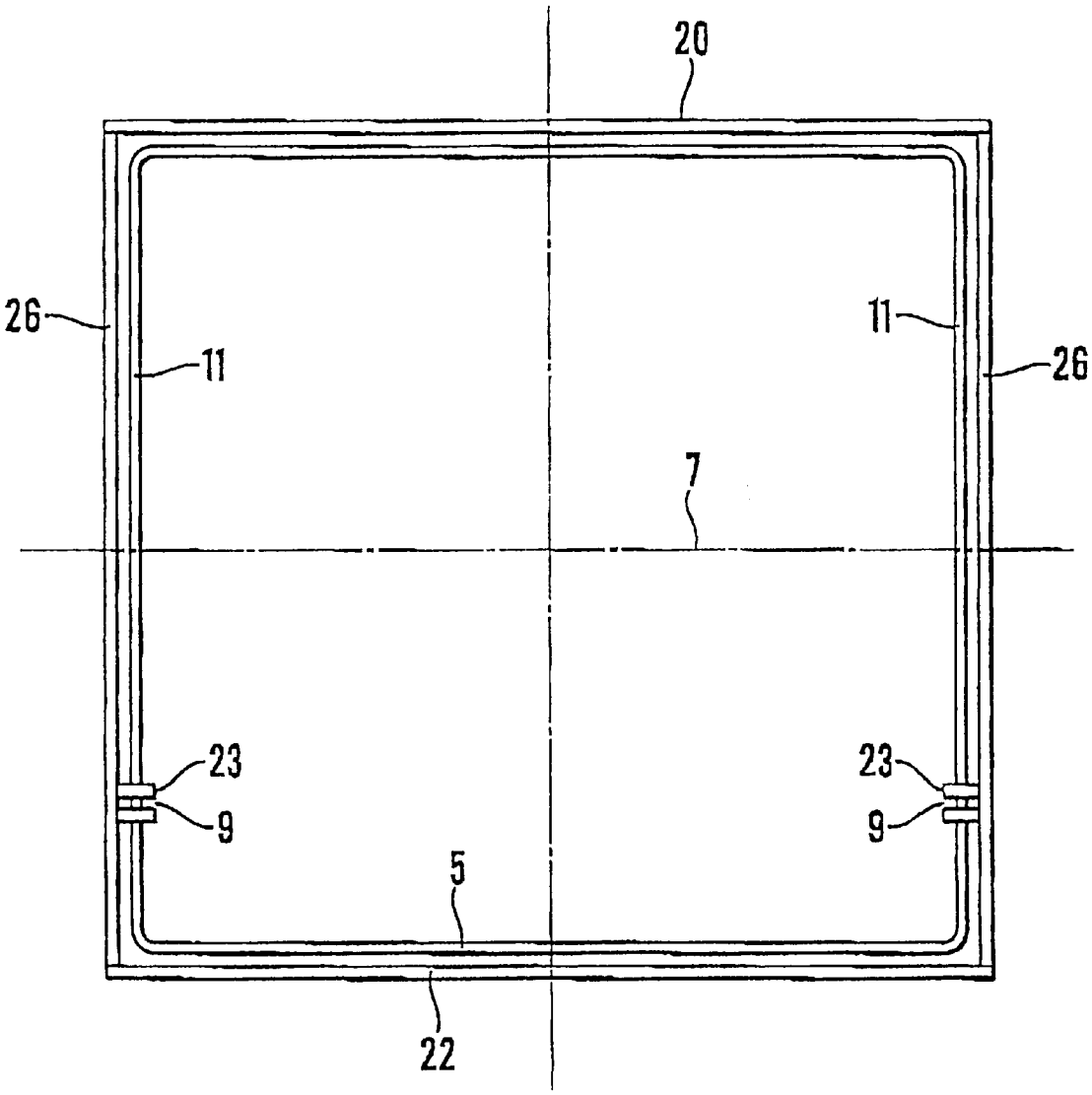
FIG. 4 is a sectional view from the front of the main body in the storage box with the drawer.

On the whole or parts of one or more sides along the outer edge of the front piece of the drawer 3, in FIG. 2 there is mounted a flange for meeting or engaging with a flange 21 which is mounted on corresponding areas of the opening 24 in the main body 2. In FIG. 3 the opening 24 and the flange 21 in the main body 2 are illustrated located between the main body's 2 bottom 22 and top 20. The main body may assume a number of different shapes, but in a preferred embodiment it is a rectangular box with a bottom panel 22, top panel 20, side walls 26, a rear panel 25 and a front area with an opening 24. The opening 24 may comprise the whole or parts of the front area, and the opening may be provided on one or more sides with a sealing strip or a device which is designed to provide a sealing or locking meeting with the front piece 4 on the drawer 3. When mounting the drawer 3 in the main body 2 the two elements 2, 3 can have a coincident centre line 7 and the guide devices 23, 9 on the main body and the drawer respectively can be mounted at a specific distance relative to the coincident centre line 7.

The flanges 10, 21 can be provided with a sealing strip or openings in order to prevent any condensation which may arise on the inside of the storage box.

The storage box 1 is assembled by pushing the drawer 4 into the main body 2 until the flange 10 on the front piece 4 on the drawer 3 meets and/or engages with the flange 21 or on the seal provided thereon located along the whole or parts of the opening 24 in the main body 2. As illustrated in FIG. 2 the drawer 3 may be designed so that the lateral limiting edges 11 may have a height from bottom level 5 which is upwardly limited by an upper edge 8. This upper edge 8 may be located, for example, under the centre line 7, which gives the drawer 3 a form in which the area where medicines or other objects are stored is low in height and is thereby easily accessible and well-organized for a user. The drawer's 3 front piece 4 is designed in such a manner that it is suitable for attaching a label or other form of information-providing device which shows the contents of the storage box 1. It will also be possible to place name tags, for example, on the front piece 4 if the storage box 1 is used in institutions, hospitals or the like where several people wish to keep their storage boxes in the same place, e.g. in the same cold room or refrigerator. By this means it is ensured that each person who keeps his medication or the like in this place has access only to the correct medication.

On the front piece 4 there may also be provided a handle or the like which makes it easier for a user to pull the drawer 3 out of the main body 2 for use. A lock device 30 may also be provided in connection with the front piece 4, thus offering the possibility of restricting access and accessibility or direct locking of the storage box 1. In a preferred embodiment of the object of the application a lock device is provided in the front panel 4 of the drawer. Several different forms of lock mechanisms may be envisaged here, both with and without a key, but their common feature is that they represent an restriction of accessibility, thus preventing inadvertent misapplication of the contents of the box. It may be envisaged that the lock mechanism 30 can also be provided on other surfaces of the storage box, for example on the rear surface 25 of the main body 2, where the lock mechanism 30 can engage with the rear boundary 6 on the drawer 3, thereby checking the drawer 3 and preventing it from being pulled out of the main body 2.

Figure 5:
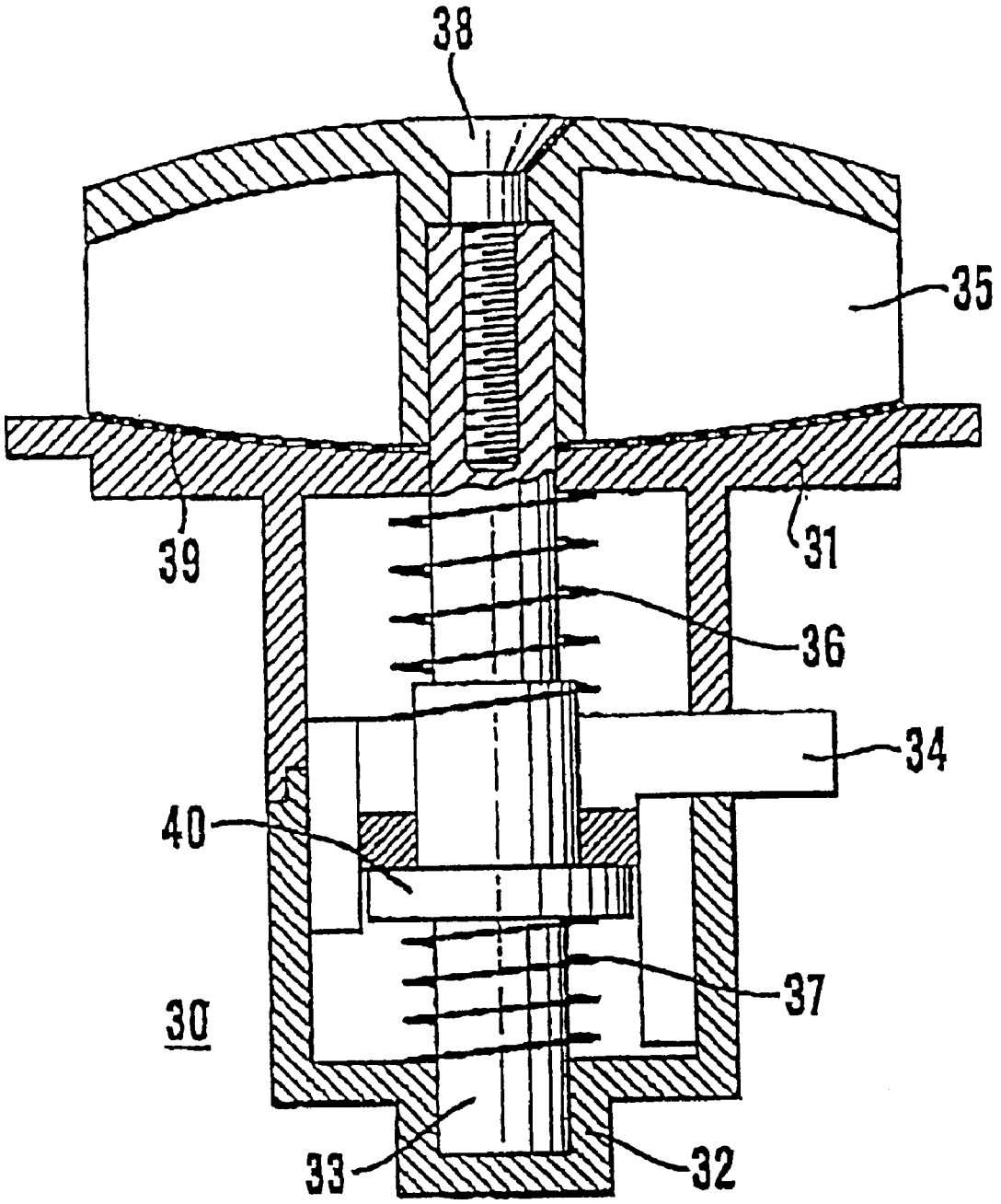
FIG. 5 is a sectional view from the side of the lock mechanism which can be employed in the storage box.

A part of the inventive concept in the present application further relates to a preferred form of a lock device 30 which is illustrated in FIG. 5, this being primarily intended for use without any kind of key, even though the lock device can easily be used with a key. The lock device 30 is designed so as to constitute an restriction of accessibility which primarily prevents children from inadvertently gaining access to the contents of the storage box 1. The lock device 30 substantially consists of a front housing 31 and a rear housing 32, which are connected when the lock device is assembled. The lock device 30 further consists of an internally through-going shaft 33 with one or more lugs 40 arranged along the circumference, which shaft 33 is further connected to a handle 35. Around the shaft 33 there is further provided a rotatable bolt 34 which has openings or recesses along the circumference of the shaft, which openings or recesses are designed in a manner corresponding to the lugs 40 on the shaft, with the result that when the handle is lifted from the seat 39 in the correct rotating position where the openings in the bolt 34 coincide with the lugs 40 on the shaft 33, a connection is formed where the handle 35 via the shaft 33 and the lugs 40 in engagement with the openings or recesses in the bolt 40 can move the bolt 40. The handle 35 is kept affixed to the shaft 33 via a screw 38 mounted in a recess in the upper part of the handle 35. Furthermore, in the front housing 31, round the shaft 33, there is mounted a compression spring 36, and in the rear housing 32 round the lower part of the shaft 33 there is mounted a torsion spring 37. When the lock device 30 is operated the handle 35 rotates freely in its seat 39 in the front housing 31, and for a child or the like it is not possible to open the lock device 30 by merely turning the handle. However, when the handle 35 is located in specific positions where the lugs 40 on the shaft coincide with the openings in the bolt, it is possible to pull the handle 35 out against the bias force of the compression spring 36. The lugs on the shaft 33 are then brought into engagement with the bolt 34, and by subsequently turning the handle 35 further it will be possible to move the bolt 34 which is engaged with the lug 13 on the main body 2 or the drawer 3, thereby releasing the lock device 30 and enabling the drawer 3 to be withdrawn from the main body 2. The compression spring 36 automatically retracts the handle 35 and the shaft 33 into the rear and front housings, 32 and 31 respectively, by means of its bias force. The handle 35 is given a resistance by the rotation of the torsion spring 37, which is mounted in the lower part of the rear housing 32. The bolt 34 may be designed in such a manner that it engages with a recess, a pin or the like 13 which is arranged in a suitable location on the inside of the main body 2, or on the drawer element 3, for an engagement between the bolt 34 and the lug 13 which provides a locking function. If the lock device 30 is installed in the upper part of the front piece 4 on the drawer 3, the lug 13 may be mounted on the inside of the top panel 20 in the main body 2, in a manner which permits locking engagement between the bolt 34 and the lug 13 when the drawer 3 is pushed completely into the main body 2. Alternatively, both the lock device 30 and the lug 13 may be installed in another location in the storage box. The bolt 34 may engage, for example, with the rear boundary 6 on the drawer 3, and in this case it is necessary for the lock device 30 to be installed on the rear panel 25, or in the rear position of the lateral boundary 26 of the main body 2. The position of the lock device 30 is not illustrated in FIGS. 1–4 since the lock device 30 may be provided in so many different positions in the storage box 1. A preferred embodiment, however, is for the lock device 30 to be installed in the front panel 4, engaging with a lug 13 on the inside of the upper panel 20 of the main body 2.

In a further embodiment the shaft may be provided with openings or recesses and the bolt may be provided with lugs.

Figure 6A:
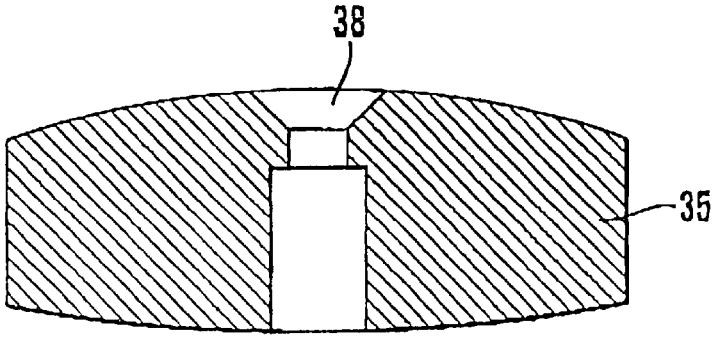
FIG. 6*a* is a sectional view from the side of the handle in the lock mechanism as illustrated in FIG. 5.
Figure 6B:
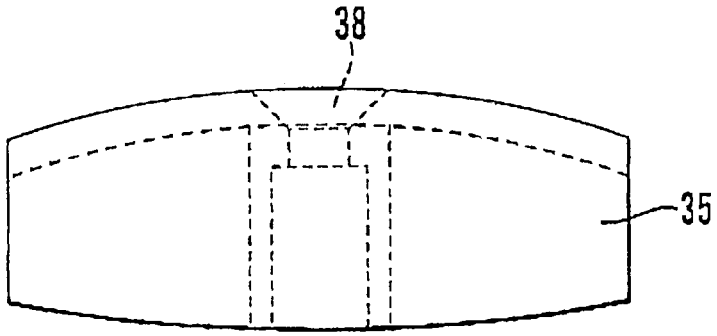
FIGS. 6*b* and *c* are views from the side and from above respectively of the handle which is employed in the lock mechanism in FIG. 5.
Figure 6C:
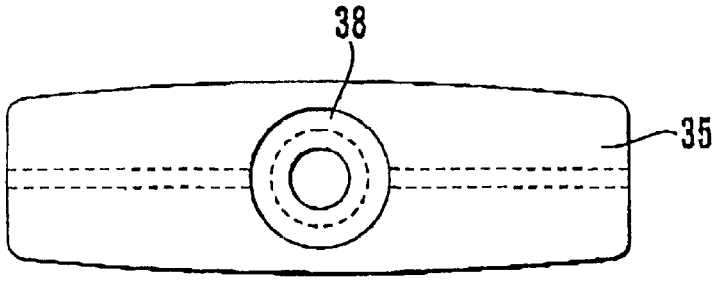
Figure 7A:
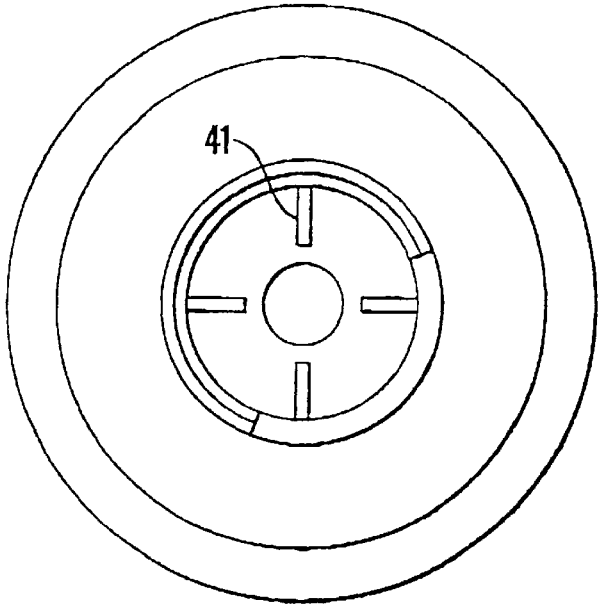
FIGS. 7*a* and *b* are views from above and from the side respectively of an embodiment of the front housing in the lock mechanism in FIG. 5.
Figure 7B:
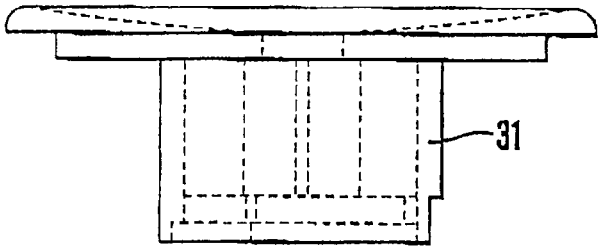
FIG. 7*c* is a sectional view from the side of an embodiment of the front housing in the lock mechanism in FIG. 5.
Figure 7C:
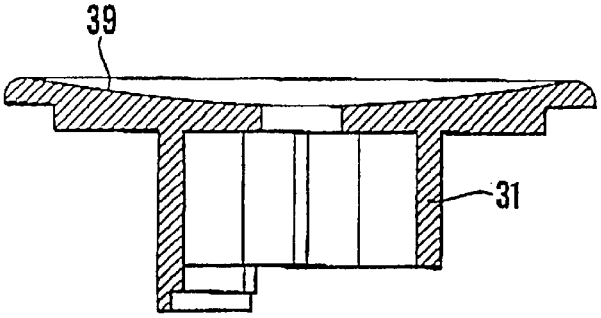

The handle 35 is further illustrated in FIGS. 6*a*–6*c* and in a view from above in FIG. 6*c* it is shown that the handle 35 may be of an oblong shape. The handle 35, however, may be designed in a number of other ways, and may also be circular, thus covering the entire seat 39 in the front housing 31. In FIGS. 6*a*–6*c* there is illustrated a recess in which it is envisaged that a screw 38 might be mounted which connects the handle 35 with the shaft 33 in the interior of the lock device 30. A further embodiment of the front housing 31 is illustrated in FIGS. 7*a*–7*c*. At one end of the housing there is provided a seat 39 whose shape is complementary to the underside of the handle 35. In this seat 39 there may also be provided raised portions 41, which indicate the positions in which the handle 35 must be in order to be able to release the lock mechanism 30. When the handle 35 is rotated about the shaft 33 the underside of the handle will abut against and be moved over the lugs 41 and when the centre line of the handle 35 is approximately parallel to the centre line of a single or several diametrically oppositely located lugs 41, this indicates that the handle 35 is in a position to be able to release the lock device 30. The compression spring 36 in the front housing 31 offers a resistance, with the result that the handle 35 does not move unimpeded over the lugs 41, but it will result in a turning resistance when the handle 35 meets the lugs 41. In a preferred embodiment it is possible to pull the handle 35 with the shaft 33 some distance further out from the seat 39 when the handle 35 is corrrectly positioned relative to the lugs 41. This causes the shaft 33 to connect the bolt 34 and the handle 35, and a further turning of the handle 35 pulls along the bolt 34, whereupon the lock device 30 disengages with, for example, the lug 13. This is a sequence of events which will be difficult to perform, for example for a child or a person with little skill and therefore introduces a restriction of accessibility to the storage box's inventive concept. Several alternatives can be envisaged, however, with regard to the position of the handle 35 relative to the seat 39, and instead of the use of lugs 41 to indicate the correct position of the handle 35 relative to the seat 39, marking on the edge of the seat 39 and the handle 35 can be envisaged. When the marks are in alignment or almost in alignment the handle is in the correct position to be able to release the lock mechanism. This, however, will provide a lesser degree of restriction of accessibility, since it will be easier for children and unskilled people to guess the correct position of the handle 35 if so-called alignment marks are placed on the seat and the handle 35. If the handle 35 is provided with lugs, an additional factor is introduced which contributes to restriction of accessibility.

The storage box 1 may further be provided in a material which is relatively stable with regard to temperature and which permits the storage of, for example, medicines in a refrigerator. In the storage box 1 there may be provided small openings in order to prevent condensation on the inside of the storage box, which is a common problem when a storage box has been exposed to the ambient temperature and then closed, whereupon it is cooled in a cold room or refrigerator in a sealed condition. These ventilation openings may be provided on one or more of the main body's surfaces or in the drawer, particularly the front panel thereof.

The figures illustrate the composition of a possible embodiment of the storage box 1 and the lock device 30, but these should not be regarded as limiting in relation to the storage box's dimensions, design or position of the lock device 30. The objects in the present invention can thereby be employed in any situation as a storage box for food, medicines or other substances where one wishes to obtain the advantages offered by the storage box 1, in the form of restriction of accessibility, collective storage, a high degree of retrievability, and the possibility of affixing labels or another information-providing device which ensures that the contents are not misused. The storage box 1 according to the present invention is therefore only limited by the following claims.

What is claimed is:

1. A lock device for use with a storage box comprising a substantially rectangular main body with at least one open side, a drawer with a side covering the opening in a closed position where the lock device is placed on the main body or the drawer, and where the opposite of the main body or the drawer is fitted with a pin, a bolt in the lock device interacts with the pin, the lock device further includes a cylindrical housing with an enlarged end piece and a handle, the enlarged end piece forms a seat shaped in a complementary manner to an underside of the handle, the handle operates a shaft mounted centrally in the housing, the shaft is movable in a longitudinal direction against one or more springs and is rotatable in the housing about the longitudinal axis, the shaft has at least one raised lug thereon, the at least one lug being engagable with openings in the bolt, the at least one lug of the shaft being engaged with the bolt when the handle with the shaft is pulled from the seat and when the handle with the shaft is in a correct position relative to the openings in the bolt whereby the bolt is rotatable via the shaft and handle.

2. The lock device according to claim 1, further comprising a housing for the lock device, the housing having a front housing and a rear housing.

3. The lock device according to claim 2, wherein the one or more springs includes at least a torsion spring, the torsion spring being around the shaft in the rear housing and providing twisting resistance when the handle is turned.

4. The lock device according to claim 2, wherein the one or more springs includes at least a compression spring, the compression spring being around the shaft in the front housing and providing resistance when the handle is pulled from the seat in order to operate the lock device, the compression spring returns the handle to contact with the seat when the handle is released by a user.

5. The lock device according to claim 2, wherein the rear housing has an opening over an angular section of thereof in order to restrict rotation of the bolt together with the shaft.

6. The lock device according to claim 1, wherein the one more springs includes at least a torsion spring, the torsion spring being around the shaft and providing twisting resistance when the handle is turned.

7. The lock device according to claim 1, wherein the one or more springs includes at least a compression spring, the compression spring being around the shaft and providing resistance when the handle is pulled from the seat in order to operate the lock device, the compression spring returns the handle to contact with the seat when the handle is released by a user.

* * * * *